US011530610B1

(12) United States Patent
Rowe et al.

(10) Patent No.: US 11,530,610 B1
(45) Date of Patent: Dec. 20, 2022

(54) DRILLING SYSTEM WITH FLUID ANALYSIS SYSTEM

(71) Applicant: Halliburton Energy Services, Inc., Houston, TX (US)

(72) Inventors: Mathew Dennis Rowe, Spring, TX (US); Shaun Patrick Lawrence, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/331,600

(22) Filed: May 26, 2021

(51) Int. Cl.
*E21B 49/00* (2006.01)
*E21B 21/06* (2006.01)
*E21B 21/08* (2006.01)

(52) U.S. Cl.
CPC ..... *E21B 49/005* (2013.01); *E21B 21/067* (2013.01); *E21B 21/08* (2013.01)

(58) Field of Classification Search
CPC ..... E21B 21/067; E21B 21/08; E21B 49/005
See application file for complete search history.

(56) References Cited

U.S. PATENT DOCUMENTS

| | | | |
|---|---|---|---|
| 4,492,862 | A | 1/1985 | Grynberg et al. |
| 4,887,464 | A | 12/1989 | Tannenbaum et al. |
| 5,199,509 | A | 4/1993 | Wright et al. |
| 7,392,138 | B2 | 6/2008 | Frechin et al. |
| 7,465,426 | B2 | 12/2008 | Kerherve et al. |
| 7,520,166 | B2 | 4/2009 | Frechin et al. |
| 7,748,266 | B2 | 7/2010 | Evrard et al. |
| 8,011,238 | B2 | 9/2011 | Hanson |
| 8,561,718 | B2 | 10/2013 | Calleri |
| 8,616,051 | B2 | 12/2013 | Kimour et al. |
| 8,899,348 | B2 | 12/2014 | Henderson et al. |
| 8,939,021 | B2 | 1/2015 | Daniel et al. |
| 9,341,606 | B2 | 5/2016 | Coleman et al. |
| 9,671,381 | B2 | 6/2017 | Karoum et al. |
| 9,765,617 | B2 | 9/2017 | Gosney et al. |
| 10,180,062 | B2 | 1/2019 | Pickell et al. |
| 10,371,691 | B2 | 8/2019 | Strapoc et al. |

(Continued)

FOREIGN PATENT DOCUMENTS

| | | | |
|---|---|---|---|
| EP | 3182119 | A1 | 6/2017 |
| WO | 2004027208 | A1 | 4/2004 |

(Continued)

OTHER PUBLICATIONS

International Search Report and Written Opinion dated Feb. 18, 2022 for corresponding PCT Application No. PCTUS2021034550 filed May 27, 2021.

*Primary Examiner* — D. Andrews
(74) *Attorney, Agent, or Firm* — K&L Gates LLP

(57) ABSTRACT

A drilling system for drilling a borehole. The drilling system includes a drilling fluid pump operable to circulate fluid through the borehole and a fluid analysis system to analyze returned fluid from the borehole. The fluid analysis system includes a sensor system, a recirculation system, and a control system in electronic communication with the drilling fluid pump and the recirculation system. The sensor system is operable to measure one or more properties of the returned fluid. The recirculation system includes a pump and controllable valves and is operable to control flow of the returned fluid through the fluid analysis system.

20 Claims, 6 Drawing Sheets

(56) References Cited

U.S. PATENT DOCUMENTS

| | | | |
|---|---|---|---|
| 2013/0192360 | A1 | 8/2013 | Jamison et al. |
| 2016/0084023 | A1 | 3/2016 | Calleri |
| 2016/0160641 | A1 | 6/2016 | Rowe et al. |
| 2017/0107773 | A1* | 4/2017 | Shekhar ..... E21B 21/067 |
| 2017/0183926 | A1 | 6/2017 | Bernard |
| 2017/0321505 | A1 | 11/2017 | Murphy et al. |
| 2017/0328200 | A1 | 11/2017 | Forstner et al. |

FOREIGN PATENT DOCUMENTS

| | | | |
|---|---|---|---|
| WO | 2010081981 | A2 | 7/2010 |
| WO | 2017067641 | A1 | 4/2017 |
| WO | 2017076490 | A1 | 5/2017 |
| WO | 2020185094 | A1 | 9/2020 |

* cited by examiner

DRILLING SYSTEM WITH FLUID ANALYSIS SYSTEM

BACKGROUND

This section is intended to provide relevant background information to facilitate a better understanding of the various aspects of the described embodiments. Accordingly, these statements are to be read in this light and not as admissions of prior art.

In the oil and gas industry, many different types of fluids are circulated into a borehole and subsequently returned to the surface. Such fluids, often referred to as "returned fluid," can include, but are not limited to, drilling fluid, completion fluids, fracturing fluids, stimulations fluids, spotting fluids, borehole treatment fluids, etc. Fluid returns are often analyzed by well operators in order to determine various borehole parameters.

For instance, while a well is being drilled, various measurements can be obtained from fluid returns from a drilling fluid. For example, these measurements provide a running log or record of the drilling operation, which permits a well operator to analyze the earth formations that are progressively being penetrated by the drill bit. The running log generated from the measurements can be particularly important because it can enable the well operator to ascertain the presence of oil, gas, and/or other formation fluids in the formations being penetrated. For instance, it is possible by comparing the ratios of methane to each of several other hydrocarbon gases present in the fluid return, such as ethane, propane, butane and pentane, to estimate whether a well will be productive and, if so, whether the well will produce oil, gas or water. Beyond this, the running log may prove advantageous in providing ratios for total gas content to oil content, water content, location relative to formation, depositional environment, and further aid in drilling optimization.

In order to measure the type and amount of a fluid found in the particular formation being drilled, the drilling fluid returning to the surface can be continuously or discretely sampled and introduced into fluid analysis system. However, drilling fluid is not returned to the surface and sampled when new drillpipe is being added to the drill string. This pause in the flow of the returned drilling fluid into the fluid analysis system can lead to inaccurate results from the fluid analysis system due to the gas within the fluid not being extracted properly.

BRIEF DESCRIPTION OF THE DRAWINGS

Embodiments of the fluid analysis system are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a drilling system with a fluid analysis system. The fluid analysis system includes sensors, a thermal energy device, a degasser system, and a recirculation system. The fluid analysis system operates in a normal mode while fluid is flowing up the borehole and operates in a recirculation mode when the flow of fluid is paused, such as when new drill pipe is added to the drill string.

When operating in normal mode, the fluid analysis system analyzes fluid returned from the borehole, gas is removed from the analyzed fluid, and the analyzed fluid is transferred to a storage tank. Occasionally, the drilling system pauses operation, such as when additional drill pipe must be added to the drill string, which causes flow of returned drilling fluid to stop. When flow of fluid is stopped, the fluid analysis system can switch to operating in recirculation. When operating in recirculation mode, fluid within the fluid analysis system is circulated through the fluid analysis system instead of being transferred to the tank. Recirculating the flow allows the sensors to continue operating instead of pausing operation until the flow of fluid through the drilling system is restored. Allowing the continued operation of the sensors increases the accuracy of the sensors since the sensors do not need to re-stabilize after flow through the fluid sensor system is reestablished after a pause.

By way of definition, a main borehole may in some instances be formed in a substantially vertical orientation relative to a surface of the well, and a lateral borehole may in some instances be formed in a substantially horizontal orientation relative to the surface of the well. However, reference herein to either the main borehole or the lateral borehole is not meant to imply any particular orientation, and the orientation of each of these boreholes may include portions that are vertical, non-vertical, horizontal or non-horizontal. Further, the term "uphole" refers a direction that is towards the surface of the well, while the term "downhole" refers a direction that is away from the surface of the well.

Figure 1:
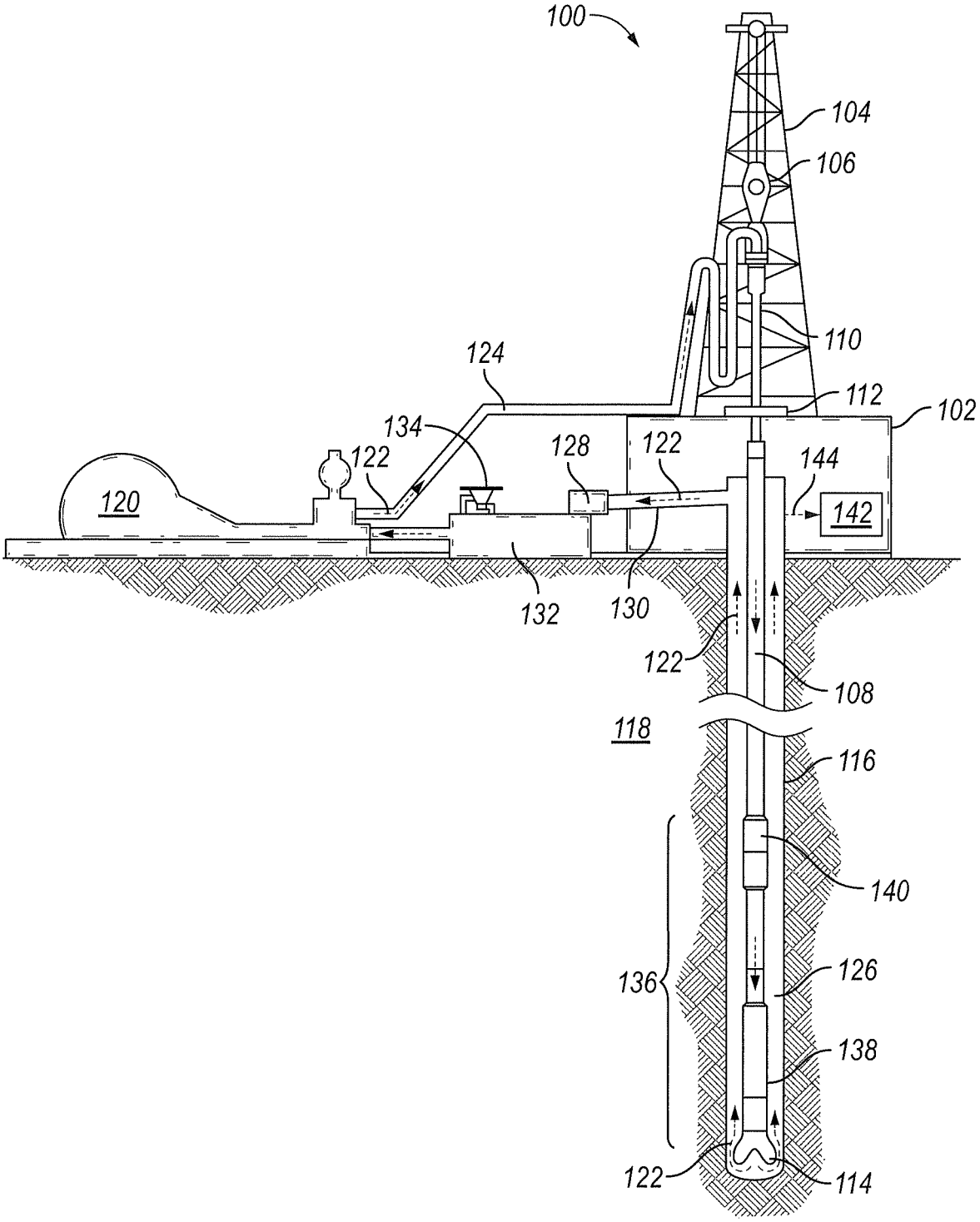
FIG. 1 is a schematic view of a drilling system, according to one or more embodiments.

FIG. 1 is a schematic view of a drilling system 100, according to one or more embodiments. The drilling system 100 includes drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the bit 114 rotates, it creates a borehole 116 that penetrates various subterranean formations 118.

It should be noted that while FIG. 1 generally depicts a land-based drilling system 100, those skilled in the art will readily recognize that the principles described herein are equally applicable to subsea drilling operations that employ floating or sea-based platforms and rigs, without departing from the scope of the disclosure. The principles may also be applicable to other forms of drilling including, but not limited to, dual gradient drilling, managed pressure drilling, and underbalanced drilling.

A drilling fluid pump 120 (e.g., a mud pump) circulates a fluid 122 through a feed pipe 124 and into the interior of the drill string 108. In some embodiments, the fluid 122 may be a drilling fluid used in the presently described drilling system 100. However, it should be noted that the principles of the present disclosure are equally applicable to any type of fluid return or sampled fluid derived from a borehole. Accordingly, usage of "the fluid 122" is meant to encompass, without limitation, any other type of fluid that may be circulated through a borehole, produced at the surface at or near the platform 102, or sampled downhole and subsequently provided to the fluid analysis system 142. For instance, "the fluid 122" may equally apply to reservoir fluids, gases, oils, water, and any other fluid that may be produced from a borehole. Moreover, the drilling system 100 may equally be replaced or otherwise equated with any borehole fluid analysis system, such as a wellhead installation used to produce fluids to the surface.

In the drilling system 100, the fluid 122 may be conveyed via the drill string 108 to the drill bit 114 and out at least one orifice in the drill bit 114. The fluid 122 is then circulated back to the surface via an annulus 126 defined between the drill string 108 and the walls of the borehole 116. At the surface, the recirculated or spent fluid 122 exits the annulus 126 and may be conveyed to one or more fluid processing unit(s) 128 via a fluid return line 130. After passing through the fluid processing unit(s) 128, a "cleaned" fluid 122 is deposited into a nearby retention pit 132 (i.e., a mud pit). One or more chemicals, fluids, or additives may be added to the fluid 122 via a mixing hopper 134 communicably coupled to or otherwise in fluid communication with the retention pit 132.

The drilling system 100 may further include a bottom hole assembly (BHA) 136 arranged in the drill string 108 at or near the drill bit 114. The BHA 136 may include any of a number of sensor modules 138 (one shown) which may include formation evaluation sensors and directional sensors, such as measuring-while-drilling and/or logging-while-drilling tools. The BHA 136 may also contain a telemetry system 140 that induces pressure fluctuations in the fluid flow. Data from the downhole sensor modules 138 are encoded and transmitted to the surface via the telemetry system 140 whose pressure fluctuations, or "pulses," propagate to the surface through the column of fluid flow in the drill string 108. At the surface the pulses are detected by one or more surface sensors (not shown), such as a pressure transducer, a flow transducer, or a combination of a pressure transducer and a flow transducer.

During the drilling operation, a discrete or continuous sample of the fluid 122 returning to the surface (i.e., the fluid returns) may be obtained and conveyed to a fluid analysis system 142 arranged at or near the drilling platform 102. The sample may be conveyed to the fluid analysis system 142 via a suction tube 144 fluidly coupled to a source of the fluid 122 returning to the surface. In some embodiments, for instance, the suction tube 144 may be fluidly coupled to the fluid return line 130. In other embodiments, however, the suction tube 144 may be directly coupled to the annulus 126 such that a sample of the fluid 122 may be obtained directly from the well at or near the surface of the well. For example, the fluid analysis system 142 may alternatively be arranged within the fluid return line 130 prior to the fluid processing unit(s) 128 and the suction tube 144 may be omitted. Alternatively, the suction tube 144 may be coupled to the possum belly at the mud tanks or a header box associated with the fluid processing unit(s) 128, without departing from the scope of the disclosure.

Figure 2:
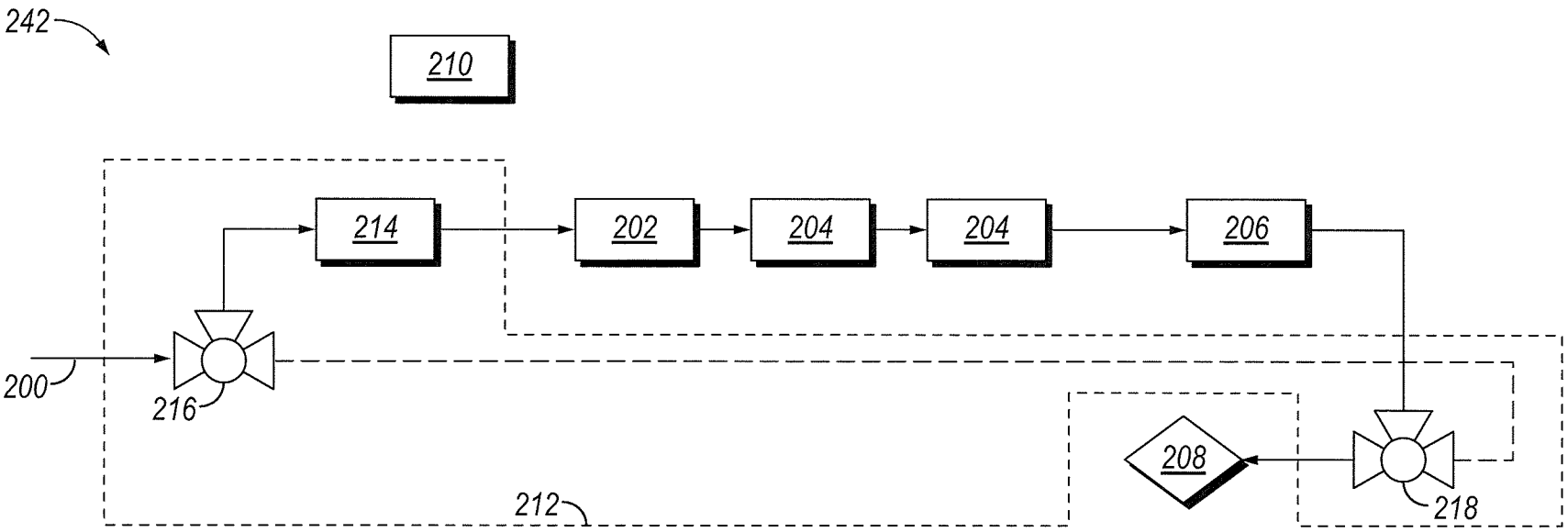
FIG. 2 is a schematic diagram of a fluid analysis system in normal mode, according to one or more embodiments.
Figure 3:
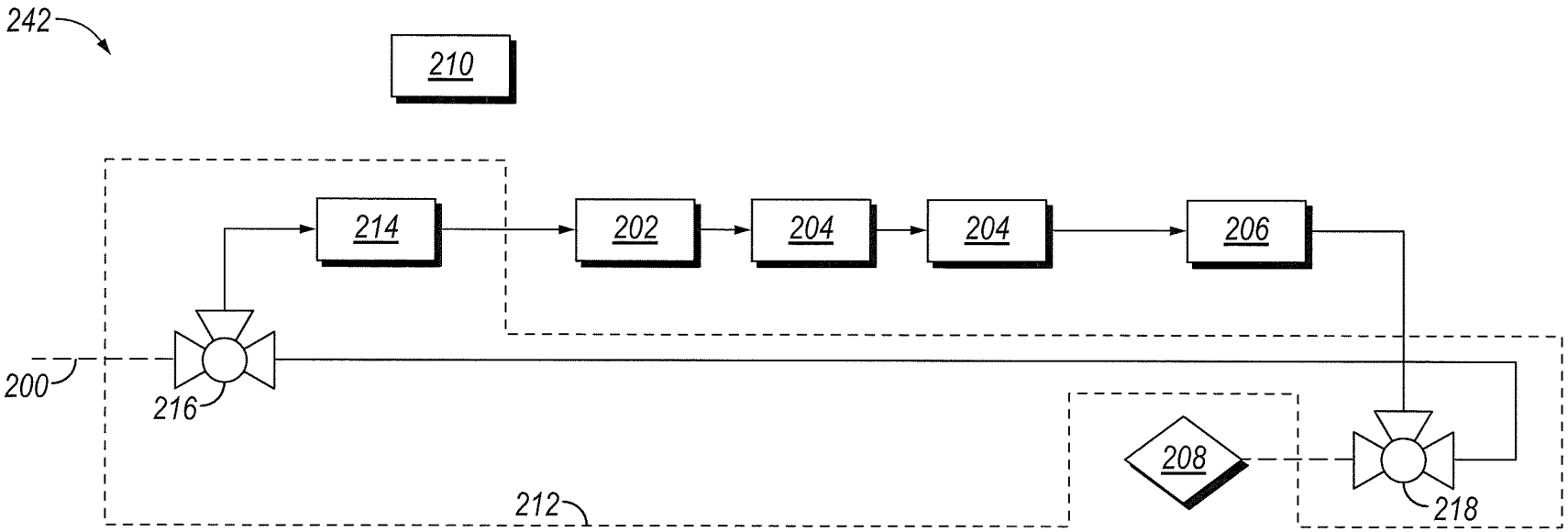
FIG. 3 is a schematic diagram of the fluid analysis system of FIG. 2 in recirculation mode.

Turning now to FIGS. 2 and 3, FIGS. 2 and 3 are schematic diagrams of a fluid analysis system 242 operating in normal mode and recirculation mode, respectively, according to one or more embodiments. As shown in FIG. 2, the fluid analysis system 242 receives a fluid sample 200 extracted from a source of a borehole fluid, as generally described above. The fluid sample 200 may be any type of borehole fluid including, but not limited to, a completion fluid, a fracking fluid, a borehole treatment fluid, a reservoir fluid, a gas, oil, water, and any combination thereof. The fluid sample 200 may alternatively be derived from production fluids being drawn out of the borehole.

The fluid analysis system 242 includes a sensor system 202, thermal energy devices 204, a degasser system 206, a storage tank 208, a control system 210, and a recirculation system 212. The recirculation system 212 includes a pumping system 214, an inlet valve 216, and an outlet valve 218. The inlet valve 216 and the outlet valve 218 are in electronic communication with the control system to control the flow of fluid through the fluid analysis system 242, as described in more detail below. The inlet valve 216 and outlet valve 218 depicted in FIGS. 2 and 3 are three-way valves; however, two two-way valves (not shown) may be used in place of the three-way valves. Additionally, although two thermal energy devices 204 are shown in FIGS. 2 and 3, other embodiments may include none, one, three, or more thermal energy devices 204. Further, additional equipment, such as valves (not shown), storage tanks (not shown), pumping systems (not shown), or sensor systems (not shown), may be included in the fluid analysis system 242 to perform additional functions, receive fluid from additional sources, and/or further control the flow of fluid through the fluid analysis system 242.

In addition to the inlet valve 216 and the outlet valve 218, the control system 210 is in electronic communication with a pump circulating fluid into a drill string, such as the drilling fluid pump 120 described above with reference to FIG. 1. The control system 210 monitors one or more properties of the drilling fluid pump to determine if they are above the threshold(s) indicative of a sufficient flow of fluid such that a fluid sample can be taken from the returned fluid. The control system 210 may monitor the drilling fluid pump 120 either directly or indirectly by receiving information from another control system (not shown) or device in electronic communication with the drilling fluid pump 120 and the control system 210. The property or properties being monitored include, but are not limited to, the flowrate produced by the drilling fluid pump and/or the RPM of the drilling fluid pump. In addition to or in place of monitoring the drilling fluid pump, the control system 210 may also monitor other pieces of drilling equipment or monitor the flowrate of the circulating fluid at one or more locations within the drilling system.

As long as the property of the drilling fluid pump is above a predetermined threshold (e.g., 50 gpm or 10 RPM), indicating there is sufficient returned fluid to take a fluid sample 200, the fluid analysis system 242 operates in normal mode, as shown in FIG. 2. When the property of the drilling fluid pump drops below the predetermined threshold, there would be insufficient returned fluid to take a fluid sample 200 and the control system 210 transitions to operate in recirculation mode. To do so, the control system 210 actuates the inlet valve 216 and the outlet valve 218 to receive fluid from a different valve inlet, as shown in FIG. 3. This may occur when a new pipe is added to the drill string or when fluid flow is otherwise paused, thus resulting in the monitored property dropping below the threshold. When the property of the drilling fluid pump returns above the predetermined threshold, the control system 210 transitions the fluid analysis system back into normal mode by actuating the inlet valve 216 and the outlet valve 218 to accept fluid from the previous valve inlet, as shown in FIG. 2.

In addition to actuating the inlet valve 216 and the outlet valve 218, the control system 210 may generate an indication, such as, but not limited to, an audible alarm, a message on a display, an electronic communication, such as a text message or an email, or any combination thereof to alert an operator of when the fluid analysis system transitions between normal mode and recirculation mode, the property drops below a predetermined threshold, and/or the property of the drilling fluid pump rises above the predetermined threshold. In other embodiments, the control system 210 may not actuate the inlet valve 216 and/or the outlet valve 218. Instead, the indication generated by the control system 210 may alert the operator that the inlet valve 216 and the outlet valve 218 need to be actuated to transition from one operation mode to the other.

When operating in normal mode, as shown in FIG. 2, the fluid sample 200 is continuously drawn from a drilling system, as described above with reference to FIG. 1. The sample pumping system 214 receives the fluid sample 200 and pumps the fluid sample 200 through the fluid analysis system at a constant flowrate, e.g., a mass constant flowrate or a volumetric constant flowrate. The fluid sample 200 is pumped through the sensor system 202, which includes sensors that measure the flowrate of the fluid, the temperature of the fluid, the density of the fluid, and/or other properties of the fluid appropriate for analyzing drilling fluid. For example, the sensor system 202 includes a Coriolis type flowmeter. Alternatively, the sensor system 202 includes other types of sensors, in addition to or in place of the Coriolis type flowmeter, to measure the properties of the fluid flowing therethrough.

The fluid sample 200 then flows through the thermal energy devices 204. The thermal energy devices 204 impart a known quantity of thermal energy (i.e., heat) to the fluid sample 200. For example, the thermal energy devices 204 may be heaters, such as resistance coil heaters or heat exchangers, which increase the temperature of the fluid sample 200 to a predetermined gas extraction temperature. The predetermined gas extraction temperature, for example, may be any temperature that does not exceed a critical temperature threshold in the fluid sample 200, past which point the fluid sample 200 may begin to break down and commence the formation of scale or dewatering of bentonite. In some fluid samples 200, for example, the critical temperature threshold may be at or about 90° C. Alternatively, the thermal energy devices 204 may be cooling devices, such as heat exchangers, evaporation units, or refrigeration units. Cooling devices may be required, for example, in applications where the fluid 122 (FIG. 1) is returned to the surface at elevated temperatures, such as greater than 100° C.

After passing through the thermal energy devices 204, the fluid sample enters the degasser system 206. The degasser system 206 extracts gases from the fluid sample 200 and analyzes the chemical composition of the extracted gases. Alternatively, the gases are extracted by the degasser system 206 and transported to a different location for analysis. The degasser system 206 may operate by using the flow energy of the incoming sample fluid to generate increased fluid velocities that help enhance the separation process. The degasser system 206 may also be configured to extract gases from the sample fluid based on a density and/or viscosity differential between the various fluidic components of the sample fluid. Once the gases have been extracted from the fluid sample 200, the fluid sample 200 may be flowed out the outlet valve 218 and into a storage tank 208. Alternatively, the fluid sample 200 may be flowed into a retention pit, such as the retention pit 132 described above, or similar fluid storage areas.

FIG. 3 shows the fluid analysis system 242 transitioned into recirculation mode where the inlet valve 216 and the outlet valve 218 are actuated such that fluid is no longer received from the drilling system and fluid from the degasser system 206 is flowed back to the pumping system 214 through the inlet valve 216, instead of into the storage tank 208. Recirculation mode allows fluid to continue to flow through the fluid analysis system 242 at a constant flowrate, even when fluid is not being sampled from the drilling system. Maintaining a constant flowrate through the fluid analysis system 242 allows the sensors (not shown) of the sensor system 202 to continue to operate normally when fluid samples 200 are not being taken. The continuous operation of the sensors increases the accuracy of the sensors, specifically when fluid sampling resumes, as the sensors do not need to re-stabilize, as they would during a pause and resumption of fluid flow through the fluid analysis system 242.

In one or more embodiments, the control system 210 may also be in electronic communication with the thermal energy devices 204 and/or the degasser system 206. If so, when the fluid analysis system 242 is operating in recirculation mode, the control system 210 may adjust or pause operation of the thermal energy devices 204 and/or the degasser system 206 until the fluid analysis system 242 transitions back to normal mode since gasses have already been extracted from the fluid circulating through the fluid analysis system 242.

Figure 4:
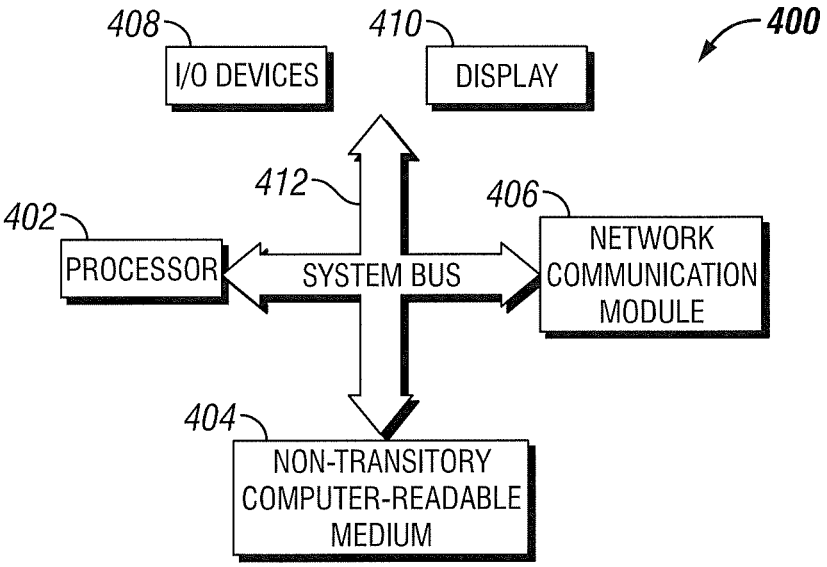
FIG. 4 is a block diagram of a computer system, according to one or more embodiments.

Turning now to FIG. 4, FIG. 4 is a computer system 400, according to one or more embodiments. The computer system 400 or a similar computer system may utilized by the fluid analysis control system, such as the control system 210 described above, in controlling the operating mode of the fluid analysis system. Additionally, the computer system 400 or a similar computer system may be utilized by a control system to control drilling operations. The computer system includes at least one processor 402, a non-transitory, computer-readable storage 404, a transceiver/network communication module 406, optional input/output devices 408, and an optional display 410 all interconnected via a system bus 412. Software instructions executable by the processor 402 for implementing software instructions stored within the computer system 400 in accordance with the illustrative embodiments described herein, may be stored in the storage 404 or some other non-transitory computer-readable medium.

Although not explicitly shown in FIG. 4, it will be recognized that the computer system 400 may be connected to one or more public and/or private networks via appropriate network connections. It will also be recognized that software instructions may also be loaded into the storage 404 from a CD-ROM or other appropriate storage media via wired or wireless means.

Figure 5:
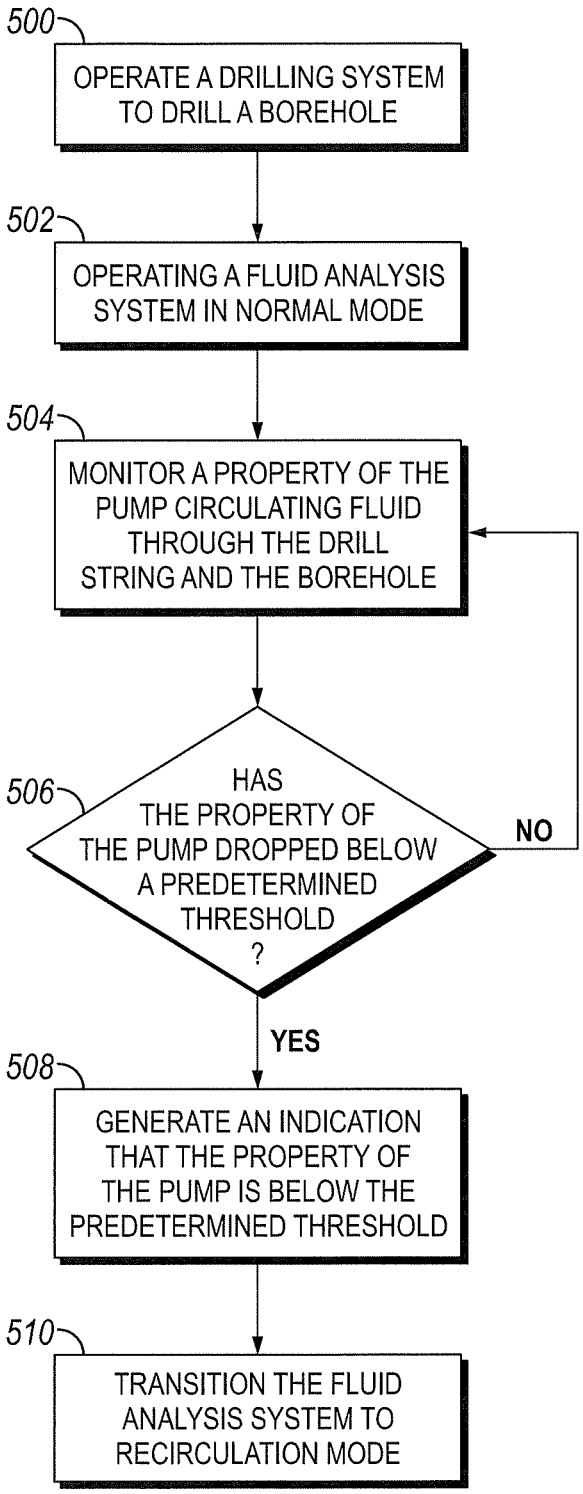
FIG. 5 is a flow chart of a method for drilling a well, according to one or more embodiments.

Turning now to FIG. 5, FIG. 5 is a flow chart of a method for drilling a well. The method may be performed by a computer system, such as the computer system 400 described above. The illustrated method enables an operator to determine a fluid analysis system, such as the fluid analysis system 242 described above with reference to FIGS. 2 and 3, should be transitioned from normal mode to recirculation mode.

In step 500, a drilling system is operated to drill a borehole, as described above with reference to FIG. 1.

In step 502, a fluid analysis system is operated in normal mode, as discussed above with reference to FIG. 2. The fluid analysis system takes fluid samples from fluid returned from the borehole, measures properties of the fluid, heats or cools the fluid, and extracts gases from the fluid. The fluid is then flowed into a storage tank.

In step 504, a property of the drilling fluid pump circulating fluid through the drill string and the borehole is monitored. The fluid analysis system control system monitors the drilling fluid pump either directly or indirectly by receiving information from another control system or device in electronic communication with the drilling fluid pump and the control system.

In step 506, if the property of the drilling fluid pump has not dropped below a predetermined threshold, the fluid analysis system continues to operate in normal mode and the fluid analysis control system continues to monitor the property of the drilling fluid pump. If the property of the drilling fluid pump has dropped below the predetermined threshold, the fluid analysis control system may optionally generate an indication to an operator that the property of the drilling fluid pump is below the predetermined threshold, as shown in step 508. The indication may be an audible alarm, a message on a display, an electronic communication, such as a text message or an email, or any combination thereof.

In step 510, the fluid analysis system is transitioned to recirculation mode, as discussed above with reference to FIG. 3. The fluid analysis system control system may actuate an inlet valve and an outlet valve to recirculate fluid within the fluid analysis system. In other embodiments, an operator may actuate the inlet valve and/or the outlet valve based on the indication from the fluid analysis system control system.

Figure 6:
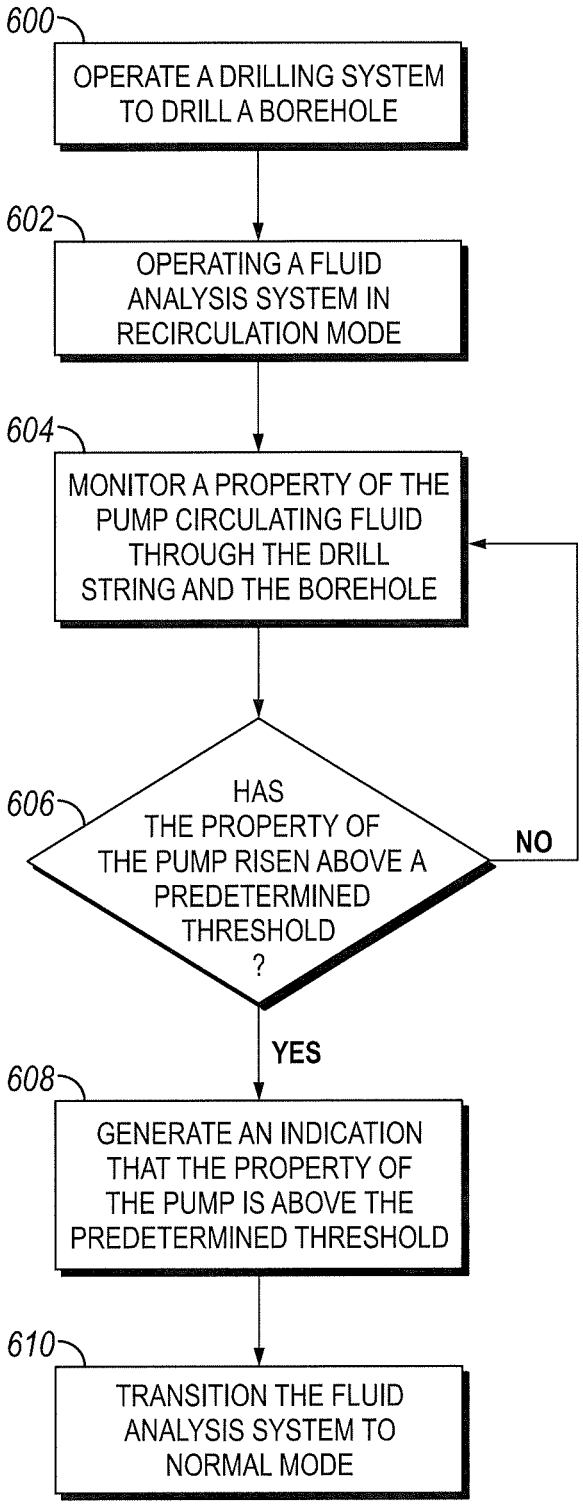
FIG. 6 is a flow chart of a method for drilling a well, according to one or more embodiments.

Turning now to FIG. 6, FIG. 6 is a flow chart of a method for drilling a well. The method may be performed by a computer system, such as the computer system 400 described above. The illustrated method enables an operator to determine a fluid analysis system, such as the fluid analysis system 242 described above with reference to FIGS. 2 and 3, should be transitioned from recirculation mode to normal mode.

In step 600, a drilling system is operated to drill a borehole, as described above with reference to FIG. 1.

In step 602, a fluid analysis system is operated in recirculation mode, as discussed above with reference to FIG. 3. Fluid within the fluid analysis system is recirculated through the fluid analysis system at a constant flowrate. This allows a sensor system within the fluid analysis system to continue to operate normally while samples of fluid are not being taken.

In step 604, a property of the drilling fluid pump circulating fluid through the drill string and the borehole is monitored. The fluid analysis system control system monitors the pump either directly or indirectly by receiving information from another control system or device in electronic communication with the drilling fluid pump and the control system.

In step 606, if the property of the drilling fluid pump has not risen above a predetermined threshold, the fluid analysis system continues to operate in recirculation mode and the fluid analysis control system continues to monitor the property of the drilling fluid pump. If the property of the drilling fluid pump has risen above the predetermined threshold, the fluid analysis control system may optionally generate an indication to an operator that the property of the drilling fluid pump is above the predetermined threshold, as shown in step 608. The indication may be an audible alarm, a message on a display, an electronic communication, such as a text message or an email, or any combination thereof.

In step 610, the fluid analysis system is transitioned to normal mode, as discussed above with reference to FIG. 2. The fluid analysis system control system may actuate an inlet valve and an outlet valve to being taking fluid samples and flowing the fluid samples through the fluid analysis system.

Further examples include:

Example 1 is a drilling system for drilling a borehole. The drilling system includes a drilling fluid pump operable to circulate fluid through the borehole and a fluid analysis system to analyze returned fluid from the borehole. The fluid analysis system includes a sensor system, a recirculation system, and a control system in electronic communication with the drilling fluid pump and the recirculation system. The sensor system is operable to measure one or more properties of the returned fluid. The recirculation system includes a pump and controllable valves and is operable to control flow of the returned fluid through the fluid analysis system. The control system is programmed to operate the fluid analysis system in a normal mode to take fluid samples of the returned fluid and analyze the fluid samples. The control system is further programmed to monitor a property of the drilling fluid pump. The control system is also programmed to determine if the property of the drilling fluid pump drops below a predetermined threshold indicative of a sufficient flow of the fluid such that the fluid samples can be taken from the returned fluid. The control system is further programmed to transition the fluid analysis system from the normal mode to a recirculation mode based on the determination to recirculate fluid through the fluid analysis system when the fluid sample cannot be taken due to a reduction in the flow of returned fluid.

In Example 2, the embodiments of any preceding paragraph or combination thereof further include wherein the control system is further programmed to generate an indication based on the determination.

In Example 3, the embodiments of any preceding paragraph or combination thereof further include wherein the control system is further programmed to determine if the property of the drilling fluid pump rises above the predetermined threshold. The control system is also programmed to transition the fluid analysis system from the recirculation mode to the normal mode based on the determination of the property rising above the predetermined threshold.

In Example 4, the embodiments of any preceding paragraph or combination thereof further include wherein the control system is further programmed to generate an indication based on the determination of the property rising above the predetermined threshold.

In Example 5, the embodiments of any preceding paragraph or combination thereof further include wherein the fluid analysis system further comprises a degasser system operable to extract gases from the returned fluid.

In Example 6, the embodiments of any preceding paragraph or combination thereof further include wherein the fluid analysis system further comprises a thermal energy device operable to heat or cool the returned fluid.

In Example 7, the embodiments of any preceding paragraph or combination thereof further include wherein the property of the drilling fluid pump includes at least one of a flowrate produced by drilling fluid pump or an RPM of the drilling fluid pump.

Example 8 is a method of drilling a borehole. The method includes circulating fluid through a borehole via a drilling fluid pump. The method also includes operating a fluid analysis system in a normal mode to take fluid samples of returned fluid from the borehole and analyze the fluid samples. The method further includes monitoring a property of the drilling fluid pump. The method also includes determining if the property of the drilling fluid pump drops below a predetermined threshold indicative of a sufficient flow of the fluid such that the fluid samples can be taken from the returned fluid. The method further includes transitioning the fluid analysis system from the normal mode and a recirculation mode based on the determination recirculate fluid through the fluid analysis system when the fluid sample cannot be taken due to a reduction in a flow of returned fluid.

In Example 9, the embodiments of any preceding paragraph or combination thereof further include generating an indication based on the determination.

In Example 10, the embodiments of any preceding paragraph or combination thereof further include determining if the property of the drilling fluid pump rises above the predetermined threshold. The method also includes transitioning the fluid analysis system from the recirculation mode to the normal mode based on the determination of the property rising above the predetermined threshold.

In Example 11, the embodiments of any preceding paragraph or combination thereof further include generating an indication based on the determination of the property rising above the predetermined threshold.

In Example 12, the embodiments of any preceding paragraph or combination thereof further include operating a thermal energy device to heat or cool the returned fluid. The method also includes operating a degasser system to extract gases from the returned fluid.

In Example 13, the embodiments of any preceding paragraph or combination thereof further include wherein the property of the drilling fluid pump includes at least one of a flowrate produced by drilling fluid pump or an RPM of the drilling fluid pump.

Example 14 is a fluid analysis system for use with drilling system that comprises a drilling fluid pump operable to circulate fluid through a borehole. The fluid analysis system includes a sensor system, a recirculation system, and a control system in electronic communication with the drilling fluid pump and the recirculation system. The sensor system is operable to measure one or more properties of the returned fluid. The recirculation system includes a pump and controllable valves and is operable to control flow of the returned fluid through the fluid analysis system. The control system is programmed to operate the fluid analysis system in a normal mode to take fluid samples of the returned fluid and analyze the fluid samples. The control system is further programmed to monitor a property of the drilling fluid pump. The control system is also programmed to determine if the property of the drilling fluid pump drops below a predetermined threshold indicative of a sufficient flow of the fluid such that the fluid samples can be taken from the returned fluid. The control system is further programmed to transition the fluid analysis system from the normal mode to a recirculation mode based on the determination to recirculate fluid through the fluid analysis system when the fluid sample cannot be taken due to a reduction in the flow of returned fluid.

In Example 15, the embodiments of any preceding paragraph or combination thereof further include wherein the control system is further programmed to generate an indication based on the determination.

In Example 16, the embodiments of any preceding paragraph or combination thereof further include wherein the control system is further programmed to determine if the property of the drilling fluid pump rises above the predetermined threshold. The control system is also programmed to transition the fluid analysis system from the recirculation mode to the normal mode based on the determination of the property rising above the predetermined threshold.

In Example 17, the embodiments of any preceding paragraph or combination thereof further include wherein the control system is further programmed to generate an indication based on the determination of the property rising above the predetermined threshold.

In Example 18, the embodiments of any preceding paragraph or combination thereof further include a degasser system operable to extract gases from the returned fluid.

In Example 19, the embodiments of any preceding paragraph or combination thereof further include a thermal energy device operable to heat or cool the returned fluid.

In Example 20, the embodiments of any preceding paragraph or combination thereof further include wherein the property of the drilling fluid pump includes at least one of a flowrate produced by drilling fluid pump or an RPM of the drilling fluid pump.

As used herein, the term "approximately" includes all values within 5% of the target value; e.g., approximately 100 includes all values from 95 to 105, including 95 and 105.

For the embodiments and examples above, a non-transitory machine-readable storage device can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

As used herein, the term "electronic communication" includes both wired communication between electronic components and/or electronic devices and wireless communication be between electronic components and/or electronic devices. "Electronic communication" also includes electronic components and/or electronic devices that are in wired or wireless electronic communication via intermediate electronic components and/or electronic devices.

In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A drilling system for drilling a borehole, the drilling system comprising:

a drilling fluid pump operable to circulate fluid through the borehole; and a fluid analysis system to analyze returned fluid from the borehole, the fluid analysis system comprising:

a sensor system operable to measure one or more properties of the returned fluid;

a recirculation system comprising a pump and controllable valves, the recirculation system operable to control flow of the returned fluid through the fluid analysis system; and a control system in electronic communication with the drilling fluid pump and the recirculation system, the control system programmed to:

operate the fluid analysis system in a normal mode to take fluid samples of the returned fluid and analyze the fluid samples;

monitor a property of the drilling fluid pump;

determine if the property of the drilling fluid pump drops below a predetermined threshold, wherein the property of the drilling fluid pump being above the predetermined threshold is indicative of a sufficient flow of the fluid such that the fluid samples can be taken from the returned fluid; and transition the fluid analysis system from the normal mode to a recirculation mode based on the determination that the property of the drilling fluid pump drops below the predetermined threshold so that the fluid sample cannot be taken due to a reduction in the flow of the returned fluid, wherein, in the recirculation mode, the fluid is recirculated within the fluid analysis system.

2. The drilling system of claim 1, wherein the control system is further programmed to generate an indication based on the determination.

3. The drilling system of claim 1, wherein the control system is further programmed to:

determine if the property of the drilling fluid pump rises above the predetermined threshold; and transition the fluid analysis system from the recirculation mode to the normal mode based on the determination of the property rising above the predetermined threshold.

4. The drilling system of claim 3, wherein the control system is further programmed to generate an indication based on the determination of the property rising above the predetermined threshold.

5. The drilling system of claim 1, wherein the fluid analysis system further comprises a degasser system operable to extract gases from the returned fluid.

6. The drilling system of claim 1, wherein the fluid analysis system further comprises a thermal energy device operable to heat or cool the returned fluid.

7. The drilling system of claim 1, wherein the property of the drilling fluid pump comprises at least one of a flowrate produced by drilling fluid pump or an RPM of the drilling fluid pump.

8. A method of drilling a borehole, the method comprising:

circulating fluid through a borehole via a drilling fluid pump;

operating a fluid analysis system in a normal mode to take fluid samples of returned fluid from the borehole and analyze the fluid samples;

monitoring a property of the drilling fluid pump;

determining if the property of the drilling fluid pump drops below a predetermined threshold, wherein the property of the drilling fluid pump being above the predetermined threshold is indicative of a sufficient flow of the fluid such that the fluid samples can be taken from the returned fluid; and transitioning the fluid analysis system from the normal mode to a recirculation mode based on the determination that the property of the drilling fluid pump drops below the predetermined threshold so that the fluid sample cannot be taken due to a reduction in a flow of the returned fluid, wherein, in the recirculation mode, the fluid is recirculated within the fluid analysis system.

9. The method of claim 8, further comprising generating an indication based on the determination.

10. The method of claim 8, further comprising:

determining if the property of the drilling fluid pump rises above the predetermined threshold; and transitioning the fluid analysis system from the recirculation mode to the normal mode based on the determination of the property rising above the predetermined threshold.

11. The method of claim 10, further comprising generating an indication based on the determination of the property rising above the predetermined threshold.

12. The method of claim 8, further comprising:

operating a thermal energy device to heat or cool the returned fluid; and operating a degasser system to extract gases from the returned fluid.

13. The method of claim 8, wherein the property of the drilling fluid pump comprises at least one of a flowrate produced by drilling fluid pump or an RPM of the drilling fluid pump.

14. A fluid analysis system for use with drilling system that comprises a drilling fluid pump operable to circulate fluid through a borehole, the fluid analysis system comprising:

a sensor system operable to measure one or more properties of returned fluid from the borehole;

a recirculation system comprising a pump and controllable valves, the recirculation system operable to control flow of the returned fluid through the fluid analysis system; and a control system in electronic communication with the drilling fluid pump and the recirculation system, the control system programmed to:

operate the fluid analysis system in a normal mode to take fluid samples of the returned fluid and analyze the fluid samples;

monitor a property of the drilling fluid pump;

determine if the property of the drilling fluid pump drops below a predetermined threshold, wherein the property of the drilling fluid pump being above the predetermined threshold is indicative of a sufficient flow of the fluid such that the fluid samples can be taken from the returned fluid; and transition the fluid analysis system from the normal mode and a recirculation mode based on the determination that the property of the drilling fluid pump drops below the predetermined threshold so that the fluid sample cannot be taken due to a reduction in the flow of returned fluid, wherein, in the recirculation mode, the fluid is recirculated within the fluid analysis system.

15. The fluid analysis system of claim 14, wherein the control system is further programmed to generate an indication based on the determination.

16. The fluid analysis system of claim 14, wherein the control system is further programmed to:

determine if the property of the drilling fluid pump rises above the predetermined threshold; and transition the fluid analysis system from the recirculation mode to the normal mode based on the determination of the property rising above the predetermined threshold.

17. The fluid analysis system of claim 16, wherein the control system is further programmed to generate an indication based on the determination of the property rising above the predetermined threshold.

18. The fluid analysis system of claim 14, further comprising a degasser system operable to extract gases from the returned fluid.

19. The fluid analysis system of claim 14, further comprising a thermal energy device operable to heat or cool the returned fluid.

20. The fluid analysis system of claim 14, wherein the property of the drilling fluid pump comprises at least one of a flowrate produced by drilling fluid pump or an RPM of the drilling fluid pump.

* * * * *